US008313348B2

(12) United States Patent
Mertens et al.

(10) Patent No.: US 8,313,348 B2
(45) Date of Patent: Nov. 20, 2012

(54) LAMP CAP AND METHOD OF MANUFACTURING THEREOF

(75) Inventors: Juergen Mertens, Aachen (DE); Vincent Deurwaarder, Wemeldinge (NL); Piet Verburg, Eindhoven (NL); Henk Te Loos, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 32 days.

(21) Appl. No.: 12/918,839

(22) PCT Filed: Feb. 24, 2009

(86) PCT No.: PCT/IB2009/050738

§ 371 (c)(1),
(2), (4) Date: Aug. 23, 2010

(87) PCT Pub. No.: WO2009/107060

PCT Pub. Date: Sep. 3, 2009

(65) Prior Publication Data

US 2011/0003515 A1 Jan. 6, 2011

(30) Foreign Application Priority Data

Feb. 29, 2008 (EP) ..... 08305042

(51) Int. Cl.
*H01R 33/09* (2006.01)

(52) U.S. Cl. ..... 439/619; 439/699.2

(58) Field of Classification Search ..... 439/340, 439/611, 613, 617, 619, 675, 699.2, 918
See application file for complete search history.

(56) References Cited

U.S. PATENT DOCUMENTS

| | | | |
|---|---|---|---|
| 5,823,806 | A | 10/1998 | Nagase et al. |
| 5,871,377 | A | 2/1999 | Sato et al. |
| 6,239,539 | B1 | 5/2001 | Mochiduki et al. |
| 7,097,343 | B2 | 8/2006 | Tiesler-Wittig et al. |
| 7,119,483 | B2 | 10/2006 | Westemeyer et al. |
| 2002/0163288 | A1 | 11/2002 | Behr et al. |
| 2003/0232544 | A1 | 12/2003 | Ohsumi |

FOREIGN PATENT DOCUMENTS

| | | | |
|---|---|---|---|
| DE | 29507879 | U1 | 8/1995 |
| DE | 29823160 | U1 | 4/1999 |
| EP | 0522362 | A | 1/1993 |

*Primary Examiner* — Khiem Nguyen

(74) *Attorney, Agent, or Firm* — John F. Salazar; Mark L. Beloborodov

(57) ABSTRACT

A lamp cap (100) comprising a base part (101) defining a cavity (102) for receiving a socket (203) of a lamp, the base part (101) having a lateral wall arrangement (103) limiting the cavity (102) and a ring shaped bottom side (104) surrounding an aperture (105); an electrical insulating interface (106) fixed to the bottom side of the base part (104) in such a manner that it covers the aperture (105), a space (102) being defined between the electrical insulating interface (106) and the lateral wall arrangement (103); and an electrical connector assembly (120) extending through the electrical insulating interface (106) to provide an electrical connection between the lamp socket (203) and an electrical power supply. A method of and apparatus for manufacturing a lamp cap is also described.

10 Claims, 6 Drawing Sheets

LAMP CAP AND METHOD OF MANUFACTURING THEREOF

FIELD OF THE INVENTION

The present invention relates to a lamp cap. Particularly, but not exclusively, the invention relates to a lamp cap for mounting a lamp on a headlight assembly of a vehicle. The invention further relates to a headlight assembly including such a lamp cap. The invention also concerns a method of manufacturing such a lamp cap.

BACKGROUND OF THE INVENTION

Lamp caps are used for mounting a lamp element such as a burner on a lamp holder. The lamp element generally comprises a light source for generating light disposed within a bulb of transparent material. The lamp cap can be made of metal and/or plastic material and includes connection means for engaging with the lamp holder. The lamp cap is generally provided with electric contacts which engage with corresponding electrical contacts of the lamp holder for supplying electrical power to the lamp element of the lamp.

A lamp assembly comprising a lamp cap and a burner can be used, for example in the headlight of a vehicle. The lamp burner can be fixed at a predetermined position with respect to the reflector of the headlight to ensure that light from the light source illuminates the reflector to form a beam in the required direction for driving the vehicle. Accurate positioning of the lamp relative to the reflector is important for obtaining an optimal reflection of the light radiated by the lamp.

Typically, some types of lamp cap are manufactured by thermosetting processes. The use of thermo-set materials, however, suffers from the drawback that the processing times and production yields are not optimised. In addition, the availability of these thermo-set materials is limited and prices are rising, and the processing time of thermo-set materials is longer. Moreover, the thermo-set materials used in the manufacturing process have negative environmental effects.

SUMMARY OF THE INVENTION

Accordingly, it would be advantageous to provide a lamp cap which can be manufactured with reduced costs, increased output yields and with less negative environmental effects.

To better address one or more of the foregoing concerns, in accordance with a first aspect of the invention there is provided a lamp cap comprising: a base part defining a cavity for receiving a socket of a lamp through a first side along a main axis of the lamp cap, the base part having a lateral wall arrangement limiting the cavity and a ring shaped second opposing side surrounding an aperture; an electrical insulating interface fixed to the second side of the base part in such a manner that it covers the aperture, a space being defined between the electrical insulating interface and the lateral wall arrangement; and an electrical connector assembly extending at least partly through the electrical insulating interface to provide an electrical connection between the lamp socket and an electrical power supply.

In an embodiment the electrical insulating interface is sealed to the second side of the base part.

The lamp cap may comprise referencing means for positioning the lamp cap during manufacturing and/or fitting of the lamp cap. In a particular embodiment the referencing means may be provided by a pair of opposing planar surfaces of the lateral wall arrangement of the base part.

In an embodiment the electrical connector assembly may include a pair of electrical connectors, each electrical connector including a first end portion for providing an electrical connection with an electrical power supply, a second end portion extending within the electrical insulating interface towards the lamp, and an intermediate portion between the first end portion and the second end portion extending within the electrical insulating interface and for electrically contacting an electrical connector of the lamp, wherein the second end portion is disposed closer to the central axis of the lamp cap than the first end portion such that that a minimum predetermined distance is defined between the inner surface of the base part and the electrical connector assembly. In a particular embodiment the intermediate portion may be provided with a cone shaped aperture for receiving an electrical connecting element of the lamp. In an embodiment the first end portion and the second end portion form an S shape through the electrical insulating interface.

The base part may be provided with a flange extending around a major portion of the base part for positioning the lamp cap in a lamp holder.

A second aspect of the invention provides a lamp cap comprising: a support ring for receiving a socket of a lamp through a first side, the ring element having inner walls defining a cavity and a second opposing side surrounding an aperture; an electrical insulator fixed to the second side of the ring element to cover the aperture, a gap being provided between the electrical insulator and the inner walls of the ring element, an electrical connector extending through the electrical insulator to provide an electrical connection between the lamp socket and an electrical power supply A third aspect of the invention provides a headlight for a vehicle, the headlight comprising a lamp, a reflector for reflecting light from the lamp into a light beam and a lamp cap according to any of the embodiments hereinbefore described for connecting the lamp to a lamp holder of the reflector.

A fourth aspect of the invention provides a method of manufacturing a lamp cap, the method comprising: providing a base part defining a cavity for receiving a socket of a lamp through a first side, the base part having a lateral wall arrangement limiting the cavity and a ring shaped second opposing side surrounding an aperture;

feeding the base part to a mould device of an insert moulding processing system; feeding at least one electrical connector to the mould device; holding the base part and at least one electrical connector in place with respect to one another; clamping the mould device and injecting thermoplastic material into the mould device such that moulding of the thermoplastic fixes the base part with respect to the at least one electrical connector; the thermoplastic being moulded in such a manner that it covers the aperture of the second opposing side of the base part and a gap is provided between the thermoplastic and the lateral wall arrangement.

The method may include providing the lateral wall arrangement with a pair of opposing planar surfaces; and aligning the base part in a feeding apparatus according to the pair of opposing planar surfaces.

In a embodiment the method includes providing an electrical connector including: a first end portion for providing an electrical connection with an electrical power supply, a second end portion extending within the electrical insulating interface towards the lamp, and an intermediate portion between the first end portion and the second end portion extending within the electrical insulating interface and for electrically contacting an electrical connector of the lamp, wherein the second end portion is disposed closer to the central axis of the lamp cap than the first end portion such that that a minimum predetermined distance is defined between the inner surface of the base part and the electrical connector assembly.

The method may include providing the electrical connector with a cone shaped aperture, the method further providing an electrical connection between the electrical connector and an electrical conductive element for providing an electrical connection to a lamp element by means of the cone shaped aperture.

A fifth aspect of the invention provides an apparatus for manufacturing a lamp cap, the lamp cap comprising a base part defining a cavity for receiving a socket of a lamp, the base part having a lateral wall arrangement limiting the cavity and a ring shaped bottom side surrounding an aperture, the apparatus including a mould device for moulding thermoplastic material; feeding means for feeding the base part and at least one electrical connector to the mould device; holding means for holding in place the base part and the at least one electrical connector in the mould device with respect to one another; a clamp for clamping the mould device; an injector for injecting thermoplastic material into the mould device; such that moulding of the thermoplastic fixes the base part with respect to the at least one electrical connector; in such a manner that the thermoplastic material covers the aperture of the second opposing side of the base part and a gap is provided between the thermoplastic material and the lateral wall arrangement.

In a particular embodiment, the lateral wall arrangement may be provided with a pair of opposing planar surfaces; and wherein the apparatus may include aligning means for aligning the base part in a feeding apparatus according to the pair of opposing planar surfaces.

In an embodiment the electrical connector may be provided with a cone shaped welding aperture for receiving an electrical connector element of a lamp, and the apparatus may include a welding device for providing an electrical connection to the electrical connector element via the welding aperture.

BRIEF DESCRIPTION OF THE DRAWINGS

Embodiments of the invention will now be described, by way of example only, and with reference to the following drawings in which.

DETAILED DESCRIPTION

A lamp cap according to an embodiment of the invention will be described with reference to FIGS. 1A to 6C.

Figure 1A:
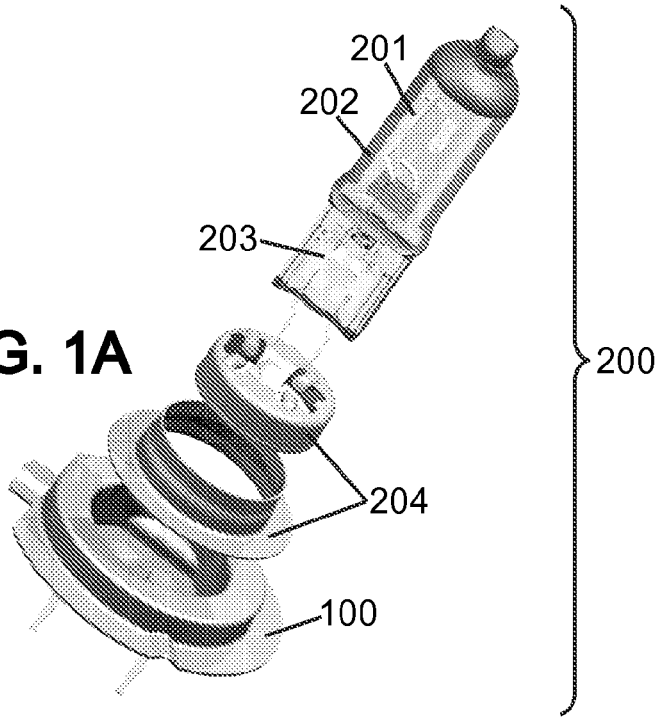
FIG. 1A is an exploded perspective view of a lamp assembly including a lamp cap according to an embodiment of the invention.
Figure 1B:
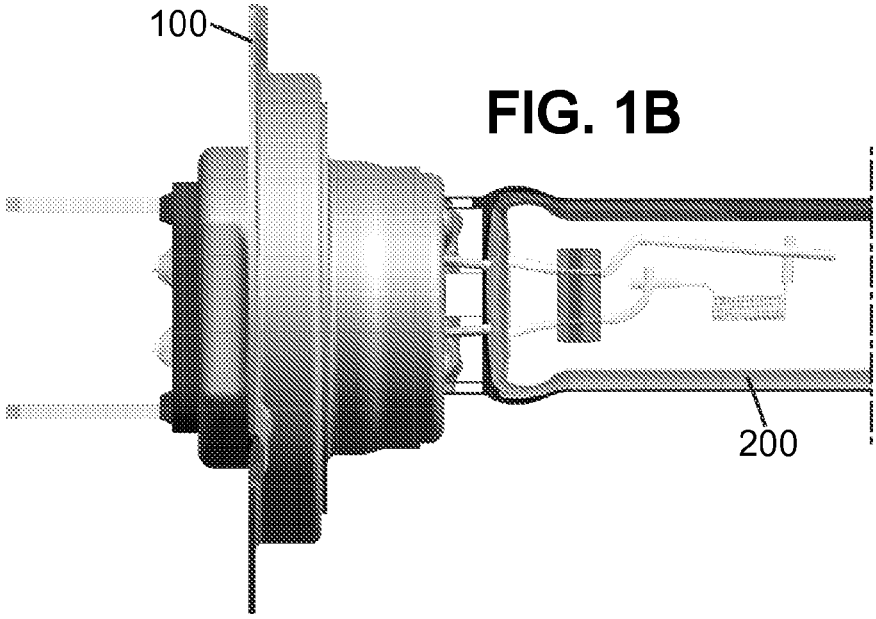
FIG. 1B is a partial perspective view of the lamp assembly of FIG. 1A.
Figure 2:
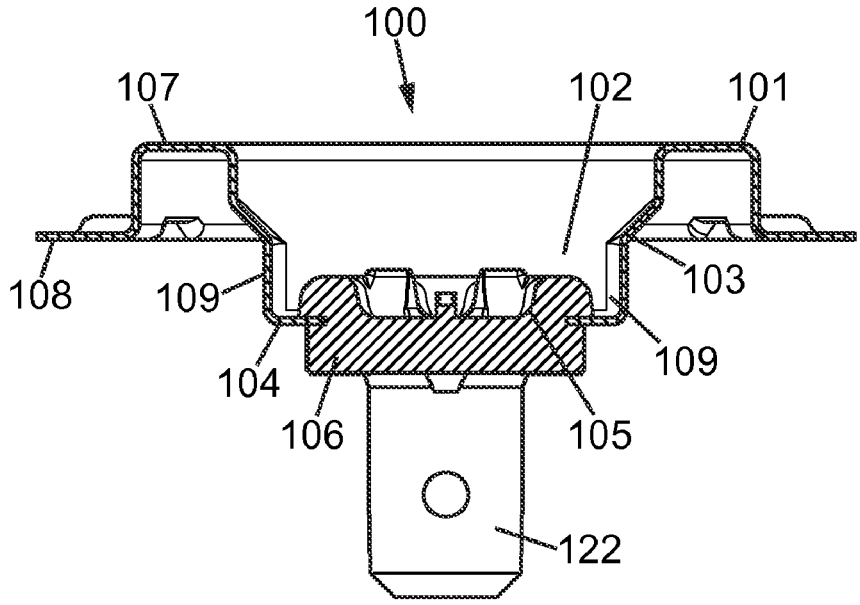
FIG. 2 is a cross-sectional view of a lamp cap according to the embodiment of the invention taken along line II-II' of FIG. 5A.
Figure 3:
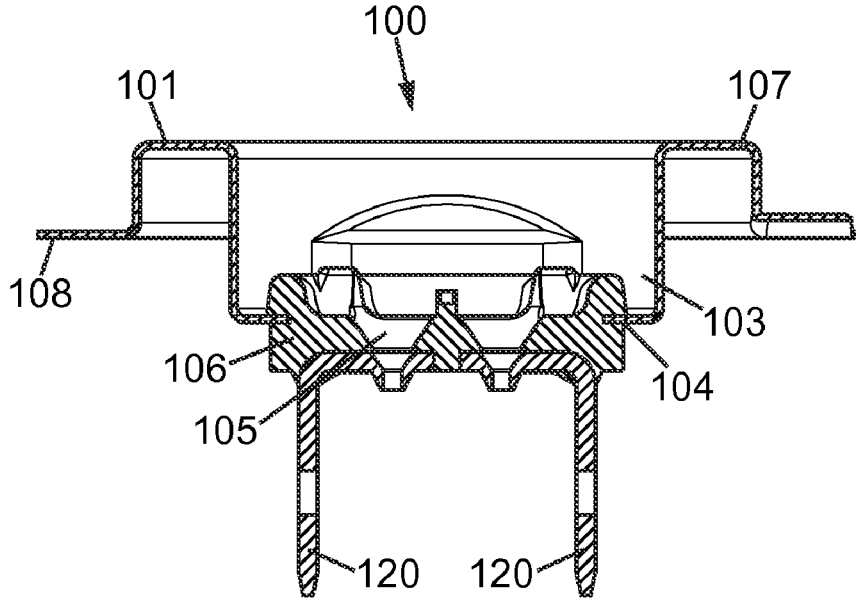
FIG. 3 is a cross-sectional view of a lamp cap according to the embodiment of the invention taken along line III-III' of FIG. 5B.
Figure 4A:
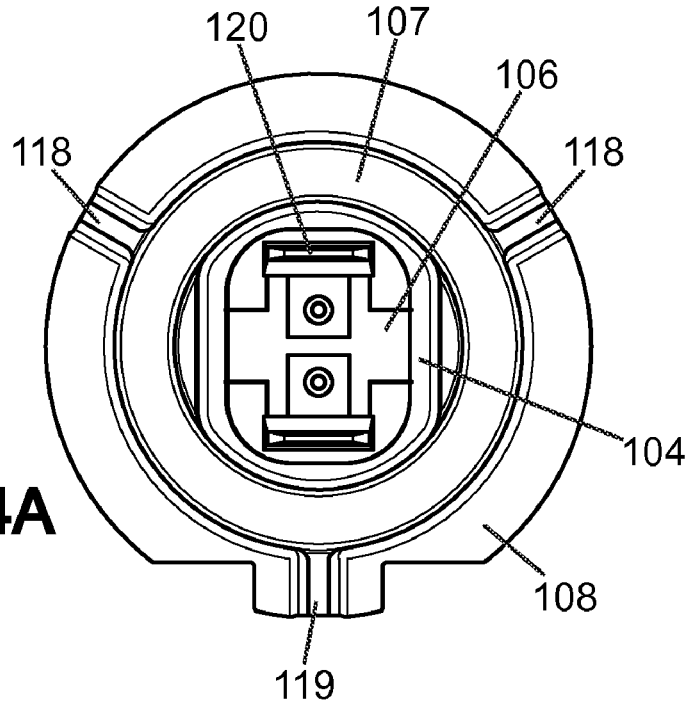
FIG. 4A is a bottom planar view of the lamp cap according to the embodiment of the invention.
Figure 4B:
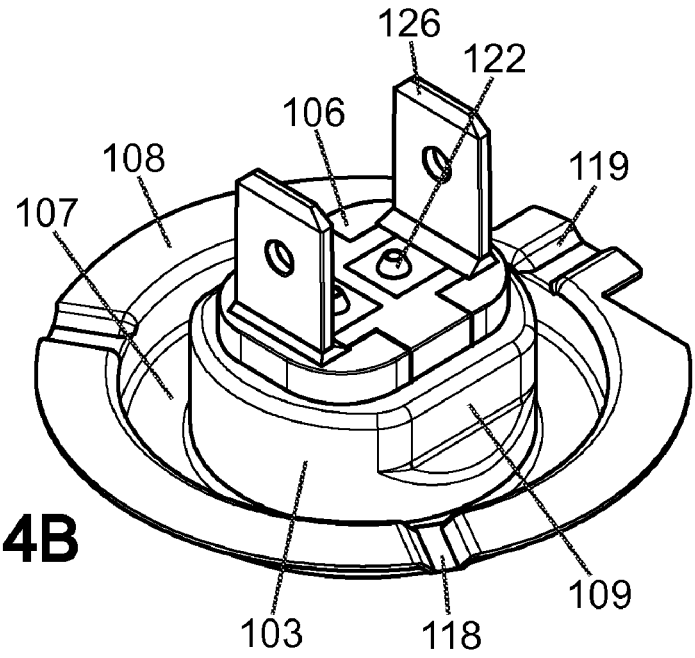
FIG. 4B depicts a view in perspective of the bottom of the lamp cap according to the embodiment of the invention.
Figure 5A:
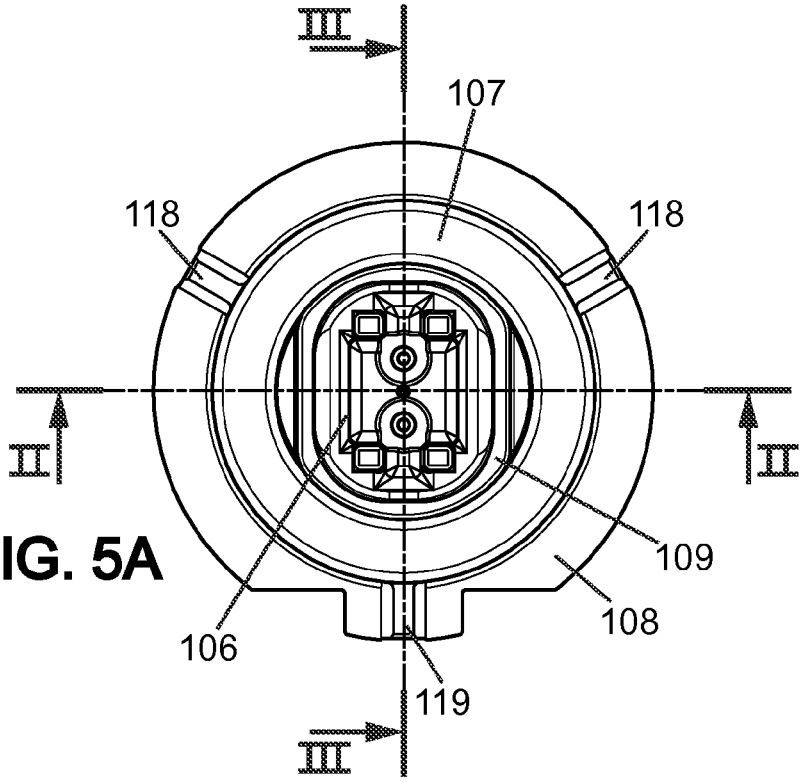
FIG. 5A is a top planar view of the lamp cap according to the embodiment of the invention.
Figure 5B:
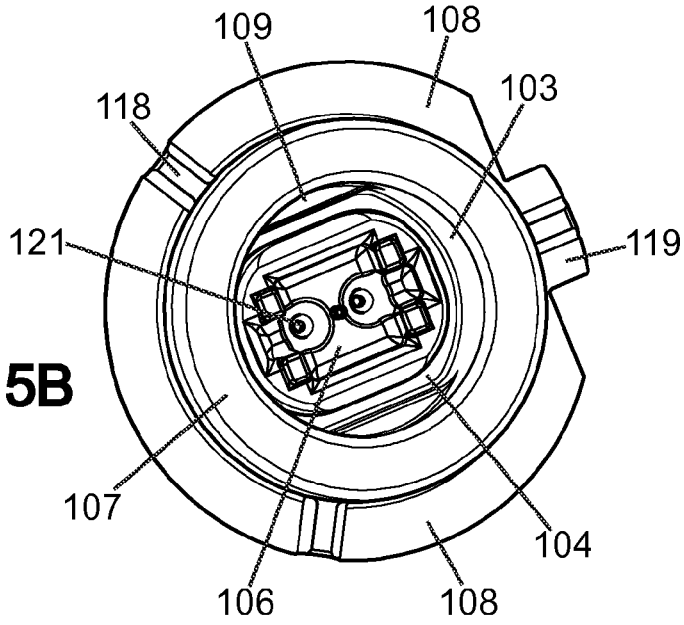
FIG. 5B depicts a view in perspective of the top of the lamp cap according to the embodiment of the invention.

FIG. 1A is an exploded perspective view of a lamp assembly comprising a burner 200 and a lamp cap 100 according to the embodiment of the invention. The burner 200 includes a light source 201 disposed inside a glass bulb 202, and having a socket 203 for connection to the lamp cap 100, and a burner base assembly 204. FIG. 1B illustrates the burner 200 mounted on the lamp cap 100. When mounted the socket 203 of the burner 200 extends through the burner base assembly 204 into a socket receiving cavity of the lamp cap 100. The lamp can be of any type, e.g. Xenon, halogen incandescent, non-halogen incandescent, LED, LED module, neon.

Lamp cap 100 is illustrated in more detail in FIGS. 2 to 5B. Lamp cap 100 comprises a base part 101. Base part 101 defines an inner cavity 102 open at a top side for receiving the socket 203 of the burner 200, and has a lateral wall arrangement 103 limiting the cavity 102 and a ring shaped bottom side 104 surrounding an aperture 105. The upper side of base part 101 is formed in the shape of a ring 107 with an outer flange 108 extending around a major portion of the base part 101 and which is used to position the lamp assembly in the reflector of a headlight. Flange 108 is provided with three recesses 118 on its lower surface. The three recesses 118 form three corresponding protrusions 118 on the upper surface of the flange 108. One of the recesses 118 provides a key feature 119 for suitably aligning the lamp cap 100 in a head light reflector or other suitable receptacle.

The lamp cap 100 further comprises an electrical insulating interface 106 made of thermoplastic material sealed or moulded to the bottom side 104 of the base part 101 in such a manner that it covers the aperture 105 and a gap is provided between the electrical insulating interface 106 and the inner surface of the lateral wall arrangement 103.

Since a gap is provided between the electrical insulating interface 106 and the inner surface of the lateral wall arrangement 103 less plastic is required to form the electrical insulating interface 106. The reduction in the quantity of plastic provides a more economical lamp cap and an improved outgassing performance. Moreover, since the electrical insulating interface 106 is sealed to the bottom side 104 of the base part 101 less tolerance is required to insert the base part 101 into the mould construction during manufacture of the lamp cap 100. This leads to an improved manufacturing process.

Lateral wall arrangement 103 is configured in a partially circular shape and includes a pair of planar opposing surfaces 109 on its external side extending from the ring shaped bottom side 104 along a portion of the wall arrangement 103 towards upper side ring 107 of the base part 101. The planar opposing walls 109 may be positioned at a predetermined position with respect to the key feature 119.

An electrical connector assembly provides an electrical interface between the burner 200 and electrical contacts of the lamp holder to be supplied by a power supply. The electrical connector assembly comprises a pair of electrical connector elements (see FIG. 6A) extending partly through the electrical insulating interface 106.

Figure 6A:
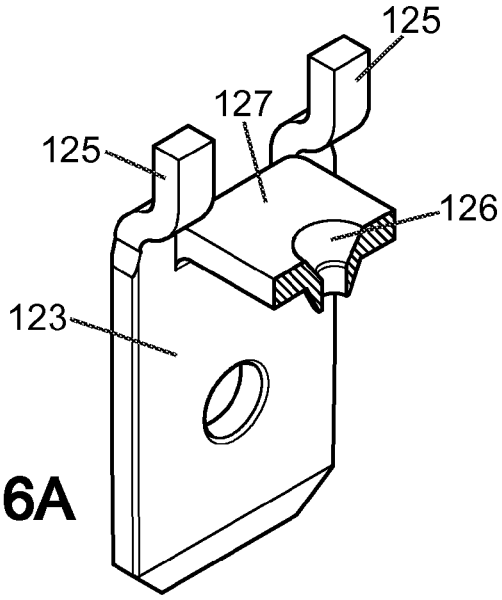
FIG. 6A is a perspective view of an electrical connector assembly for the lamp cap according to the embodiment of the invention.
Figure 6B:
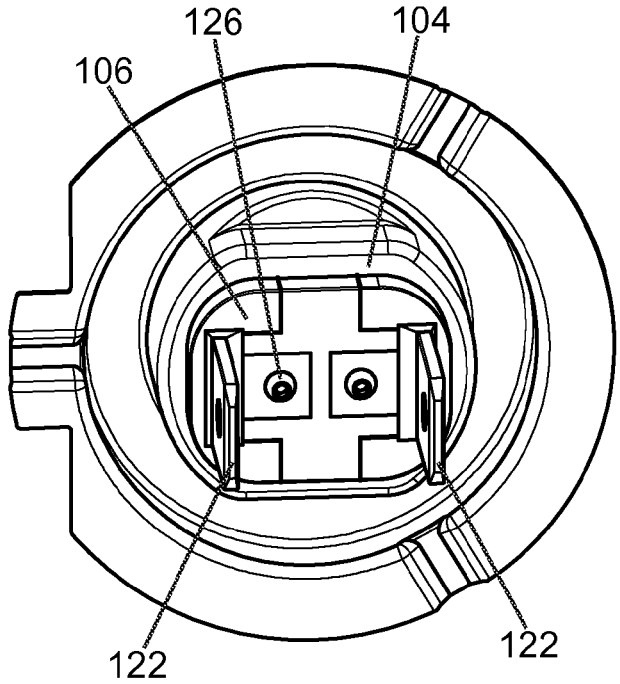
FIG. 6B depicts a view in perspective of the bottom of the lamp cap according to the embodiment of the invention.
Figure 6C:
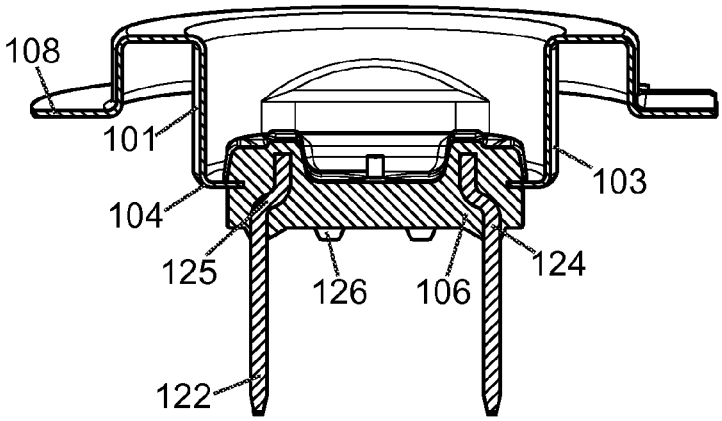
FIG. 6C illustrates the location of the electrical connector assembly of FIG. 6A in the lamp cap.

One of the electrical contacts 122 is shown in more detail in FIGS. 6A and 6B. Each electrical contact 122 includes:

a contact portion 123 extending longitudinally outwardly from a first surface of the electrical insulating surface 106 for engaging with corresponding electrical contacts of a lamp holder for providing electrical power to the burner 200;

eventually a pair of S-shaped legs 125, each one extending longitudinally within the electrical insulating interface 106 from the contact portion 123 towards a terminal part of this S-shaped leg such that this terminal part is closer to the central axis of the lamp cap 101 than the first end portion 123. This configuration of legs 125 ensures that a minimum distance is provided between the electrical contact 122 and the electrical conductive bottom side 104 of the base part 101 so that electrical contact between the electrical connector assembly and the conductive part of base portion 101 is avoided. The distance between the electrical connector assembly and the base part 101 conforms to the requirements of IEC 60061-4.

Electrical contact 122 also includes a cone shaped aperture 126 to receive and guide an electrical connector element of the lamp within, the cone shaped aperture 126 being provided at the terminal part of a planar portion 127 extending towards the central axis of the lamp cap 101 from contact portion 123. An electrical seal between the electrical connector element of the lamp and the electrical contact 122 can be made by soldering or welding through the cone shaped aperture. The well defined cone shape enables the positioning of electrical connector elements to be better controlled during the manufacturing process improving the quality of the overall product. Moreover since the cone shaped aperture is preformed on the electrical connector there is less risk of foreign substances entering the lamp cap 101 which can occur in prior art systems where an aperture is punched in the electrical connector during assemblage of the lamp cap.

The various features of the lamp cap 100 hereinbefore described, enable the lamp cap to be manufactured by an insert moulding process leading to a more efficient manufacturing process with increased yields and decreased cycle times.

Generally in an insert moulding process discrete parts of an article can be combined into a single component by the injection of thermoplastic around the discrete parts suitably positioned with respect to one another. Since insert moulding joins numerous components together with thermoplastic, assembly and labour costs can be greatly minimized. During a typical insert moulding process a custom-built mould is loaded robotically or manually with inserts (discrete parts to be assembled into the finished product). Molten thermoplastic is injected into the suitably shaped mould and upon cooling binds the inserts together. The mould is opened and the components are removed. Post-moulding assembly operations can, where appropriate, include a variety of secondary operations, to provide the final product.

By virtue of the various features of the lamp cap an insert moulding process can be used in the present invention to manufacture the lamp cap.

Figure 7:
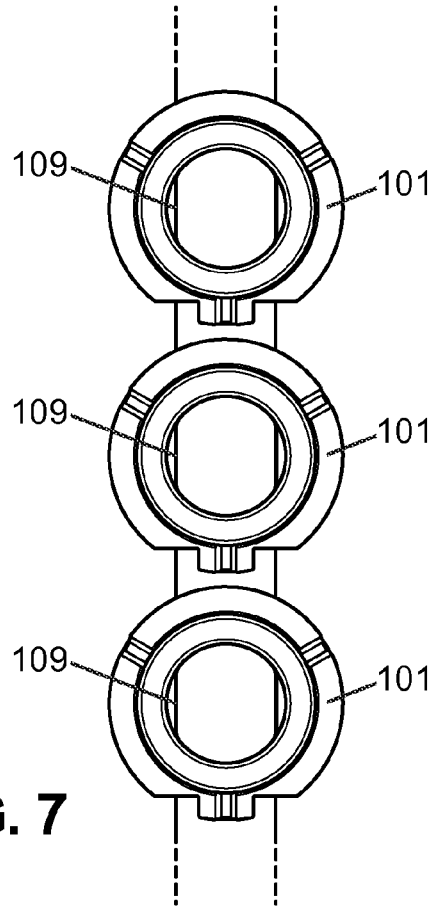
FIG. 7 is a schematic view of a lamp cap according to an embodiment of the invention in a mould feeding system.

An initial stage of the manufacturing process according to an embodiment of the invention involves feeding the metal inserts (the base part 101 and the electrical connector 122) to a moulding system. The feeding apparatus for feeding the base parts 101 includes a vibrating bowl in which the base parts 101 are fed. The vibrating bowl vibrates thereby moving each base part into different orientations with respect to a feeding channel 300 until they are in a correct orientation along an axis with respect to the axis of the feeding channel 300. With reference to FIG. 7, planar opposing walls 109 of base part 101 provide an automatic reference guiding feature for aligning the base part 101 along the axis of the feeding channel 300 in such a way that each base part in the feeding channel has the same orientation with respect to the feeding channel 300, with the planar walls 109 positioned parallel to the direction of movement of the feeding system.

Since the base parts 101 can be automatically aligned in the moulding feeding system a manual step of ring positioning may be removed from the manufacturing process thereby leading to reduced manufacturing cycle time, increased yields and reduced costs. Moreover the position of key feature 119 can be determined at the end of the feeding process since the position of the planar walls 109 is known.

The planar walls 101 may also be used as a reference for a robotic grip during manufacturing if required.

During the moulding process a thermoplastic material is moulded into a suitable form by clamped moulds to provide the electrical insulating interface and to join the base part 101 to the electrical contacts 122 of the lamp cap. During the process the pair of electrical contacts 122 and the base part 101 are placed at appropriate locations with respect to one another, thermoplastic material is injected into a clamped mould and cools to hold the electrical contacts 122 and the base part together 101 to provide the required configuration of lamp cap 100.

Sealing the plastic electrical insulating interface 106 to the bottom side 104 of the base part 101 of the lamp cap 100 enables the required tolerance for inserting the base part 101 into the mould construction to be reduced.

The gap provided between the electrical insulating interface 106 and the lateral wall arrangement 103 allows a stronger force to be applied to the mould 310 forming the electrical insulating interface 106 resulting in a higher clamping force which helps to reduce flash at edges of the plastic electrical insulating interface 106.

During manufacture of the lamp cap 100, the electrical connector legs 125 can be used to define a reference plane R for positioning the electrical contacts 122 in the plastic mould. The S-shaped configuration of the legs 125 of electrical contacts 122 provides good anchoring in the plastic of the electrical insulating interface 106.

The defined cone aperture 126 of electrical contact 122 enables the welding process for providing the electrical connections to be stabilised and provides a further feature enabling an insert moulding process to be employed for manufacturing the lamp cap 100.

In embodiments of the invention, the cavity in the tool being clamped on the flat bottom of the centring ring order enables thermo-plastic use. Thermoplastics allow a shorter cycle-time, and higher yield. To accommodate the higher yield, the centring ring has two flat sides that give pre-orientation in the production process.

The use of an insert moulding process for the manufacture of the lamp caps has many advantages. Cheaper raw thermoplastic materials can be used, a wider choice of thermoplastic materials and suppliers are available leading to reduction in costs. The thermoplastic materials require a shorter processing time compared to conventional thermosetting processes leading to increased productivity. The reference markings provided by the physical features of the lamp cap lead to a more automated process and thus a higher output of product can be achieved leading to higher yields and further economic benefits. The new manufacture process enables less plastic material to be used leading to a reduction in outgassing and undesirable environmental effects. A wider range of thermoplastic of different colours is available leading to more choice.

Embodiments of the invention find application in the headlights of vehicles. The reference features provided by the lamp cap can be used to enable automatic assembly of the lamp cap—lamp element assembly into a reflector. The predefined cone shaped feature has the advantage that it can help to reduce the risk of foreign substances being present in the head light compared to lamp caps produced by prior art thermosetting methods.

Although the present invention has been described hereinabove with reference to specific embodiments, the present invention is not limited to the specific embodiments. Many further modifications and variations will suggest themselves to those versed in the art upon making reference to the foregoing illustrative embodiments, which are given by way of example only and which are not intended to limit the scope of the invention, that being determined solely by the appended claims. In particular the different features from different embodiments may be interchanged, where appropriate.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the invention.

The invention claimed is:

1. A lamp cap comprising:

a base part defining a cavity for receiving a socket of a lamp through a first side along a main axis of the lamp cap, the base part having a lateral wall arrangement limiting the cavity and a ring shaped second opposing side surrounding an aperture;

an electrical insulating interface inserted and affixed to the second side of the base part in such a manner that it covers the aperture, a gap being provided between the electrical insulating interface and the lateral wall arrangement; and electrical connectors extending at least partly through the electrical insulating interface to provide an electrical connection between the lamp socket and an electrical power supply.

2. A lamp cap according to claim 1, wherein the electrical insulating interface is sealed to the second side of the base part.

3. A lamp cap according to claim 1, further comprising referencing means for positioning the lamp cap during manufacturing and/or fitting of the lamp cap.

4. A lamp cap according to claim 3, wherein the referencing means is provided by a pair of opposing planar surfaces of the lateral wall arrangement of the base part.

5. A lamp cap according to claim 1, wherein the electrical connectors comprises a first and second electrical connectors, each electrical connector including: a first end portion for providing an electrical connection with an electrical power supply, a second end portion for providing an electrical connection with the lamp, the second end portion being disposed closer to said main axis than the first end portion; and an intermediate portion extending between the first end portion and the second end portion within the electrical insulating interface.

6. A lamp cap according to claim 5, wherein each second end portion is provided with a cone shaped aperture for receiving a corresponding electrical connecting element of the lamp.

7. A lamp cap according to claim 5, wherein the first end portion extends mainly from the electrical insulating interface in a direction away from the first side of the cavity, and the second end portion is arranged within the electrical insulating interface with an access from the cavity being provided for connecting with the lamp.

8. A lamp cap according to claim 5, wherein at least one electrical connector further comprises a S-shaped portion extending within the electrical insulating interface from said first end portion to a terminal part of the S-shaped portion such that this terminal part is closer to said main axis than the first end portion.

9. A lamp cap according to claim 1, wherein the base part comprises a flange extending around a major portion of the base part for positioning the lamp cap in a lamp holder.

10. A lamp cap comprising a support ring for receiving a socket of a lamp through a first side, the support ring having an inner wall defining a cavity and a second opposing side surrounding an aperture; an electrical insulator fixed to the second side of the support ring to cover the aperture, a gap being provided between the electrical insulator and the inner wall of the support ring, and an electrical connector extending through the electrical insulator to provide an electrical connection between the lamp socket and an electrical power supply.

* * * * *